United States Patent [19]

Ver Hoef et al.

[11] 4,243,223

[45] Jan. 6, 1981

[54] SPINNER APPARATUS

[76] Inventors: Niel Ver Hoef, 300 Pioneer Rd., Des Mones, Iowa 50315; Donald D. Kurth, 4121-75th St., Des Moines, Iowa 50322

[21] Appl. No.: 12,352

[22] Filed: Feb. 15, 1979

[51] Int. Cl.[3] ..... A63B 71/06

[52] U.S. Cl. ..... 273/141 R; 308/139

[58] Field of Search ..... 273/141 R, 141 A, 161, 273/106.5 A; 46/58, 53, 57, 221; 308/DIG. 11, 139

[56] References Cited

U.S. PATENT DOCUMENTS

| | | | |
|---|---|---|---|
| 903,879 | 11/1908 | Nusly, Jr. | 46/58 |
| 976,492 | 11/1910 | Prickett | 273/141 R X |
| 1,048,159 | 12/1912 | Hibschman | 273/141 R |
| 1,167,407 | 1/1916 | Johnson | 273/141 R |
| 1,542,874 | 6/1925 | Hampel | 273/141 R |
| 1,578,708 | 3/1926 | Beckhardt | 273/141 R |
| 2,068,306 | 1/1937 | Weinberg | 273/106.5 A |
| 2,933,827 | 4/1960 | Alberts | 273/141 R X |
| 3,557,477 | 1/1971 | Trent et al. | 46/58 X |

*Primary Examiner*—Richard C. Pinkham
*Assistant Examiner*—Arnold W. Kramer
*Attorney, Agent, or Firm*—Henderson & Sturm

[57] ABSTRACT

A spinner that is readily disassembled for repair, replacement or storage consisting of a cylindrical post element removably receiving a rotatable apertured spinner element. The post element is tapered at one end and has an enlarged cap on the other end. The post element also has a resiliently deformable beaded collar portion on its periphery, and the aperture of the spinner element is slid over the post element and forced past the beaded collar in order to assemble or disassemble the two elements. The tapered end of the post is inserted into a resilient base member whose lower portion is a suction cup.

5 Claims, 4 Drawing Figures

SPINNER APPARATUS

BACKGROUND OF THE INVENTION

Many games of chance, amusement devices, and educational and instructional techniques have employed a rotatable spinner/pointer to produce a random selection. Examples of these prior art devices can be found in U.S. Pat. Nos. 3,399,893, 2,933,827; 2,676,019 and 2,224,997.

In the past, spinner/pointer devices have been made an integral part of a game board or similar device, required a complex manufacturing process involving a large number of parts, or have been manufactured from flimsy material not able to withstand the rough and repeated usage to which devices of this kind are normally subjected.

Other problems which these spinner/pointers have encountered are loss, breakage, difficulty in rotation, lack of portability and the lack of capability for disassembly for repair or replacement of a defective part, without destroying the device or a portion thereof.

SUMMARY OF THE INVENTION

It is an object of the spinner/pointer of the instant invention to provide a device which is simple and inexpensive to manufacture and requires very few parts.

It is a further object of this invention to provide a device which is readily assembled and disassembled for repair, replacement or storage of the components.

It is still another object of this invention to provide a stable spinner/indicator device which may be mounted, via suction, directly on a game board or at a remote location.

It is another object of this invention to provide a device which is portable, easy to repair and inexpensive to replace.

It is yet another object of this invention to provide a device which can be used in conjunction with a game or by itself to provide amusement via random selection, and which also may be provided with an additional detachable element for ornamental or amusement purposes.

These and other objects, advantages and novel features of the present invention will become apparent from the following detailed description of the invention when considered in conjunction with the accompanying drawings.

DESCRIPTION OF THE PREFERRED EMBODIMENTS

Figure 1:
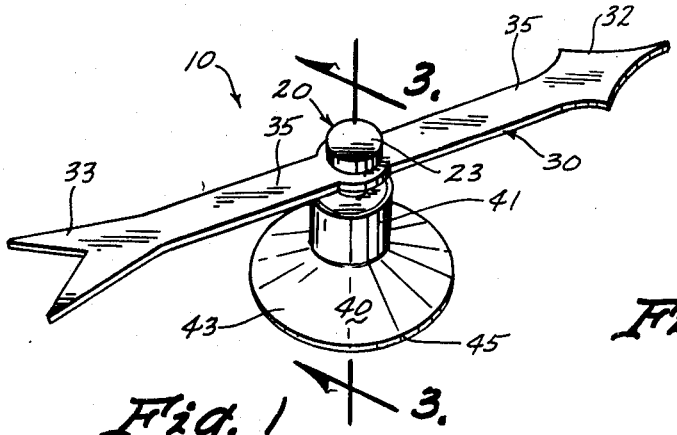
FIG. 1 is a perspective view of the spinner/indicator device of the instant invention.
Figure 2:
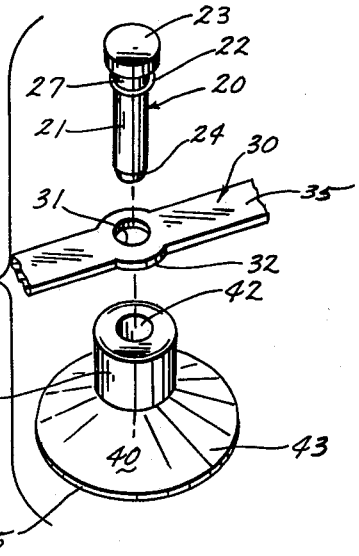
FIG. 2 is an exploded perspective view of the spinner/indicator device of the instant invention showing the three basic components prior to assembly.

FIG. 1 illustrates a preferred embodiment of the spinner/indicator device of the instant invention wherein the spinner/indicator is designated generally as 10.

The spinner/indicator 10 is composed of three basic components, a base member 40, a spinner element 30, and a support/bearing member 20.

Figure 3:
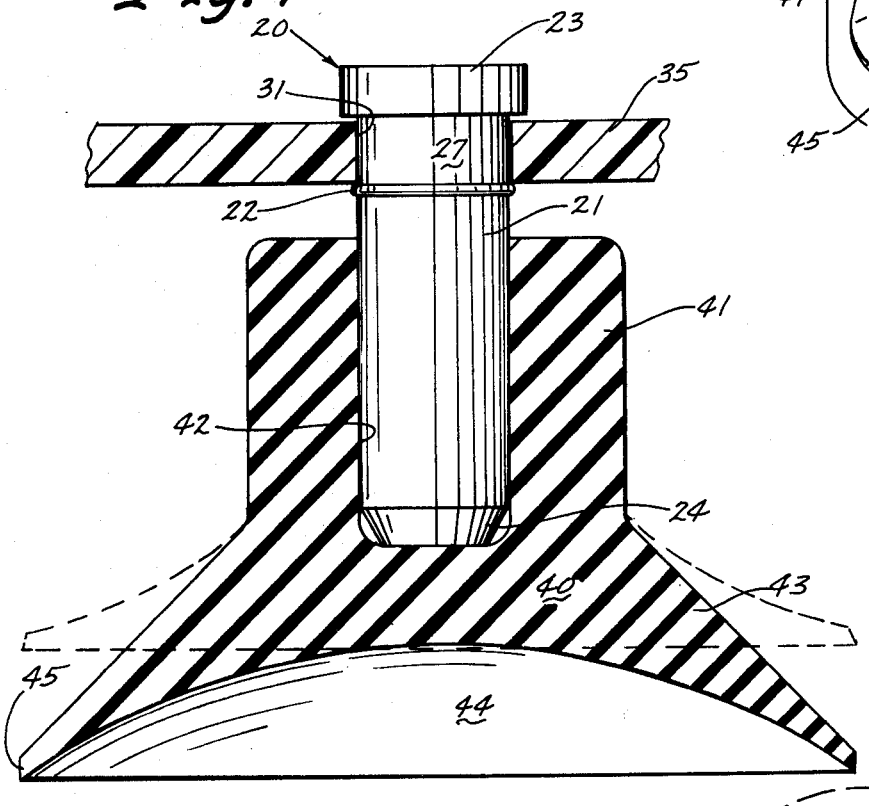
FIG. 3 is a cross-sectional view of the spinner/indicator device taken through line 3—3 of FIG. 1.

Referring now to FIG. 3, the base member 40 comprises, a conically shaped lower skirt portion 43 having a curved recessed portion 44 which terminates at the peripheral lip 45 of the skirt 43, and a centrally disposed upper cylindrical portion 41 having a concentric cylindrical aperture 42 disposed downwardly therein.

The support/bearing means 20 comprises a cylindrical post element 21 having a tapered portion 24 on one end, a cap 23 on the other end, and a beaded bearing collar 22 on its periphery.

The spinner element 30, comprises a flat elongated shaft 35 having a pointed forward section 32 and a bifurcated rearward section 33. The shaft 35 also has an aperture 31 positioned at its midpoint whose diameter is slightly greater than the diameter of the cylindrical post 21. The width of the shaft 35 is uniformly enlarged around the aperture 31 to form a collar portion 32.

The base member 40 is fabricated from a resilient material such as rubber, and the lower portion is designed to function as a suction cup. When the base member 40 is pressed against a smooth hard surface, the lower skirt portion flexes outwardly, (FIG. 3 dashed lines) evacuating air from the chamber 44, and thereby creating a strong frictional engagement between the base member 40 and the smooth hard surface.

The diameter of the aperture 42 in the base member 40 is less than the diameter of the cylindrical post element 21 and is adapted to frictionally engage the periphery of the post element 21 in their assembled relationship.

Both the spinner element 30 and the support/bearing means 20 are one piece structural members fabricated from relatively rigid, lightweight, inexpensive material such as plastic. The method of fabrication may be by injection molding, punching, etc., and the only criteria necessary is that the process be fast, simple and inexpensive.

Referring now to the dimensions and cooperating structural elements of the spinner element 30 and the support/bearing means 20, it can be seen in FIG. 3, that the diameter of the aperture 31 is greater than the diameter of the cylindrical post 21, slightly less than the diameter of the beaded bearing collar 22, and substantially less than the diameter of the cap 23.

The spinner 30 has a uniform thickness and is dimensioned such that its center of gravity (not shown) and the aperture 31 are axially aligned. When the spinner 30 is mounted on the support/bearing member 20, it should assume an almost perfectly balanced position.

The assembly of the spinner/indicator proceeds as follows: the cylindrical post 21 is inserted in the aperture 31, until the aperture 31 contacts the beaded bearing collar 22, the bearing collar may be resiliently deformed by contact with the sides of aperture 31 into a snap-fit relationship, upon the extension 27 of the cylindrical post 21. The spinner 30 is then rotationally secured between the cap 23 and the beaded bearing collar 22.

The collar portion 32 on the shaft 35 forms a uniform rotational bearing surface with the beaded bearing collar 22, and the contact of the collar portion 32 with the enlarged cap 23 prevents the spinner from flying off the post 21.

The combined assembly (20, 30) is then inserted in the member 40 to complete the assembly of the spinner/indicator device 10.

Since the spinner/indicator ideally assumes a nearly perfectly balanced position on the beaded bearing collar 22, and there is ample clearance between the walls of the aperture 31 and the cylindrical post 21, the frictional resistance between the relatively rotating parts is substantially reduced, a rotational force imparted to the spinner/indicator will provide a truly random stopping point for the rotating shaft.

Figure 4:
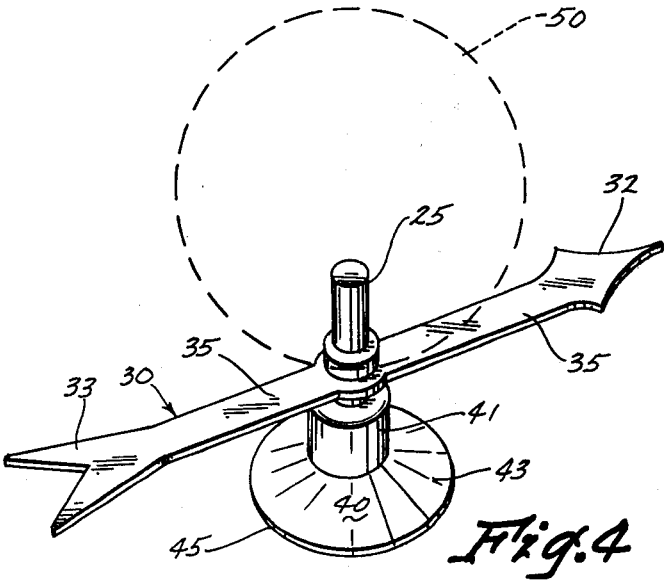
FIG. 4 is a perspective view of a modified version of the preferred embodiment shown in FIGS. 1–3 showing an additional article supporting post.

FIG. 4 shows a modification of the preferred embodiment; wherein the support/bearing member 20 is provided with an extension 25 of the cylindrical post 21 which projects above the enlarged cap 23. The extension 25 is intended to be inserted into a recess (not shown) in a ornamental or decorative object 50.

Obviously many substitutions, modifications and variations of the present invention are possible in light of the above disclosure. It is therefore to be understood, that the invention may be practiced other than as specifically described, and should only be limited by the scope of the appended claims.

What I claim is:

1. An improved spinner/indicator device for use on a relatively smooth hard surface comprising:

a rotable apertured spinner element having a pointed forward section and a bifurcated rearward section;

a cylindrical post element having a tapered section on one end, an enlarged cap on the other end, and a resiliently deformable beaded collar portion on its periphery;

a flexible, resilient base member having a conical skirted, lower portion, and an apertured cylindrical upper portion, wherein the diameter of the aperture in the spinner element is greater than the diameter of the cylindrical post, substantially less than the diameter of the enlarged cap, and slightly less than the diameter of the resiliently deformable beaded collar portion around the periphery of the cylindrical post; and the diameter of the cylindrical post is greater than the diameter of the aperture in the cylindrical upper portion of the resilient base member.

2. An Improved spinner/indicator device as in claim 1; wherein, the skirted lower portion of the base member has a recessed air chamber in the relaxed state; and a downward external force applied to the apertured cylindrical upper portion of the base member flexes the skirted lower portion outwardly, substantially evacuating the air in the recessed air chamber.

3. An improved spinner/indicator device as in claim 1; wherein the resiliently deformable beaded collar portion on the cylindrical post cooperates with the side of the aperture in the spinner element to allow the passage of the spinner element to a position on the cylindrical post between the enlarged cap and resiliently deformable beaded collar portion; and the resiliently deformable beaded collar forms a bearing surface for the rotation of the spinner element on the conical post.

4. An improved spinner/indicator device as in claim 3; wherein, the portion of the spinner element surrounding the aperture, cooperates with both the resiliently deformable beaded collar portion and the enlarged cap of the cylindrical post, to maintain the spinner element in a releasably captive rotatable relationship with the cylindrical post.

5. An improved spinner/indicator device as in claim 1; wherein, said cylindrical post element is further provided with a projection which extends above the enlarged cap and is intended for use in conjunction with a separate decorative article.

* * * * *